US007673576B2

(12) United States Patent
Miller

(10) Patent No.: US 7,673,576 B2
(45) Date of Patent: Mar. 9, 2010

(54) AERODYNAMIC LIFT ENHANCEMENT GATE VALVE

(76) Inventor: James W. Miller, 248 Randolph Dr., Bangor, ME (US) 04401

( * ) Notice: Subject to any disclaimer, the term of this patent is extended or adjusted under 35 U.S.C. 154(b) by 0 days.

(21) Appl. No.: 11/471,928

(22) Filed: Jun. 21, 2006

(65) Prior Publication Data

US 2007/0295254 A1 Dec. 27, 2007

(51) Int. Cl.
*B63H 9/04* (2006.01)
*B63H 9/06* (2006.01)
*B63B 35/79* (2006.01)

(52) U.S. Cl. ..... 114/102.13; 114/39.12; 114/39.31; 114/102.29

(58) Field of Classification Search ... 114/39.11–39.16, 114/39.21, 39.29, 102.1–102.14, 102.29, 114/39.31, 102.22, 102.28, 105
See application file for complete search history.

(56) References Cited

U.S. PATENT DOCUMENTS 4,437,425 A * 3/1984 Unden ..... 114/102.13
4,635,578 A * 1/1987 Calcabrini et al. ..... 114/91
5,732,642 A * 3/1998 DeSilva ..... 114/102.13

FOREIGN PATENT DOCUMENTS

| | | | |
|---|---|---|---|
| DE | 31 21 402 A1 | * | 12/1982 |
| DE | 3921606 A1 | * | 1/1991 |
| FR | 2 557 063 | * | 10/1983 |
| GB | 2259674 A | * | 3/1993 |
| WO | WO 84/00529 | * | 2/1984 |
| WO | WO 86/05759 | * | 10/1986 |

* cited by examiner

*Primary Examiner*—Ajay Vasudeva
(74) *Attorney, Agent, or Firm*—Gauthier & Connors LLP

(57) ABSTRACT

An aerodynamic lift enhancing gate valve assembly comprising an airfoil blade disposed at a leading edge of a sail, forming a gate between the trailing edge of the airfoil blade and the leading edge of the sail. The airfoil blade captures wind and redirects it over the cambered surface of the sail to enhance the aerodynamic lift of the sail. The pressure of the wind captured by the airfoil blade is regulated by springs or elastic bands. In operation, the chord of the airfoil blade remains substantially parallel to the chord of the sail.

8 Claims, 2 Drawing Sheets

AERODYNAMIC LIFT ENHANCEMENT GATE VALVE

BACKGROUND OF THE INVENTION

Wind surfing has become a very popular sport. It combines the thrills of surfing, and the tranquility of sailing. Windsurfing can give the unbeatable feeling of being out in the open, gliding effortlessly over beautiful, clear waters. It's a sport where you can cross great expanses with a friend or explore unchartered waters alone. A windsurfer has virtually unlimited access to the nation's waterways.

Windsurfing combines surfing and sailing by mounting a sail on a universal joint, requiring the sailor to support the rig, and allowing the rig to be tilted in any direction. This tilting of the rig fore and aft allows the board to be steered without the use of a rudder. In the early 1970's, only one board was mass produced. The durable polyethylene boards were suitable for all sailing levels, simply because they were the only boards. Beginners learned on them, and experts prevailed on them. Everyone made the windsurfer work, regardless of the conditions.

By the late 70's windsurfing fever had caught on. Equipment development progressed at a fevered pitch through the mid-80's. Since then, windsurfers on extremely specialized equipment began sailing in winds of 40 knots and above, and have pushed that speed up to an incredible level. Everyone wants to go faster and faster.

Now there are many different types of windsurfing including cruising, freestyle, slalom sailing, bump and jump sailing, and wavesailing. With all of these types of windsurfing, there is a desire to have a more aerodynamic setup such that the windsurfer can move faster and further.

SUMMARY OF THE INVENTION

An aerodynamic lift enhancement gate valve including a valve blade, which is shaped as a sail, and is disposed at the leading edge of, a sail, in such a way as to form a fluid gate, which gate is formed between the trailing edge (at the chord) of the gate valve blade, and the leading edge (nose) of the sail, (at the chord).

The gate valve blade will catch the wind, and will cause a wind velocity surface pressure to build against the upwind surface, which pressure is regulated by springs, spring rods and or elastic.

When in operation, the chord of the gate valve blade will remain substantially parallel to the chord of sail. The air particles at the upwind side of the fluid gate are under pressure, which pressure will overhaul the progressive spring rods and or elastic tension, which action will cause the air particles to escape through the fluid gate, and to accelerate as they break free from the trailing edge of the gate valve blade.

The relative position of the gate valve blade, will cause the accelerating air particles to be directed at the appropriate angle of incidence, toward the downwind cambered surface of the sail, (i.e. to enhance the aerodynamic lift (torque) to the sail).

The nose section of the gate valve blade is hinged, such that the increase in wind velocity surface pressure will cause the nose (leading edge) of the gate valve blade to swing and to move away from the nose of the sail, in such a way to reduce the aerodynamic drag break effect to the gate valve blade, which action will allow the sail to attain a high top end speed.

It is an object of the invention to have a gate valve comprising a valve blade disposed at the leading edge of an airfoil blade or a sail.

It is another object of the invention to have the valve blade being shaped as a sail.

It is still another object of the invention to incorporate the gate valve with the sailboard.

These and other features and objectives of the present invention will now be described in greater detail with reference to the accompanying drawings, wherein:

DETAILED DESCRIPTION OF THE INVENTION

Figure 1:
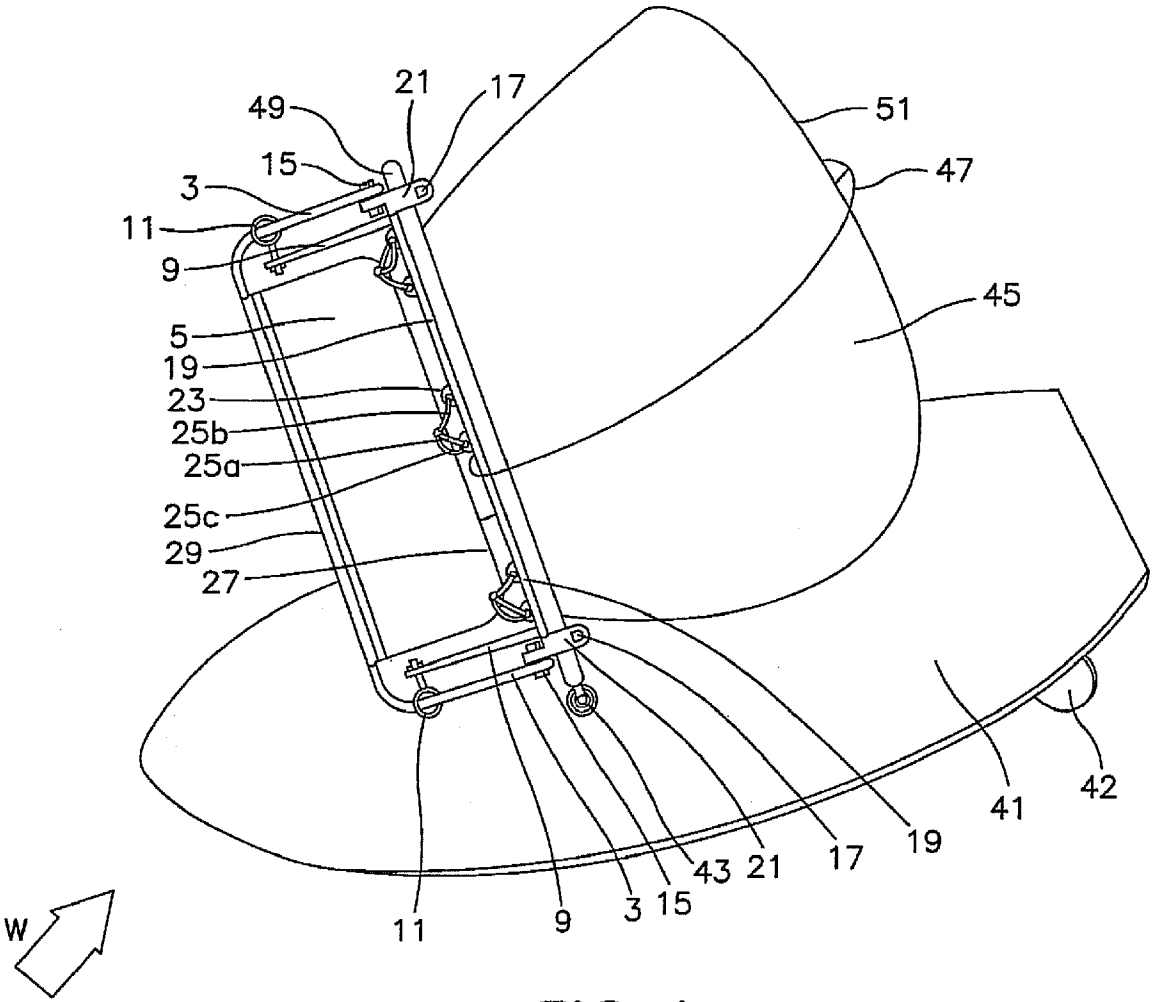
FIG. 1 is a windsurfer according to the invention disclosed herein.
Figure 2:
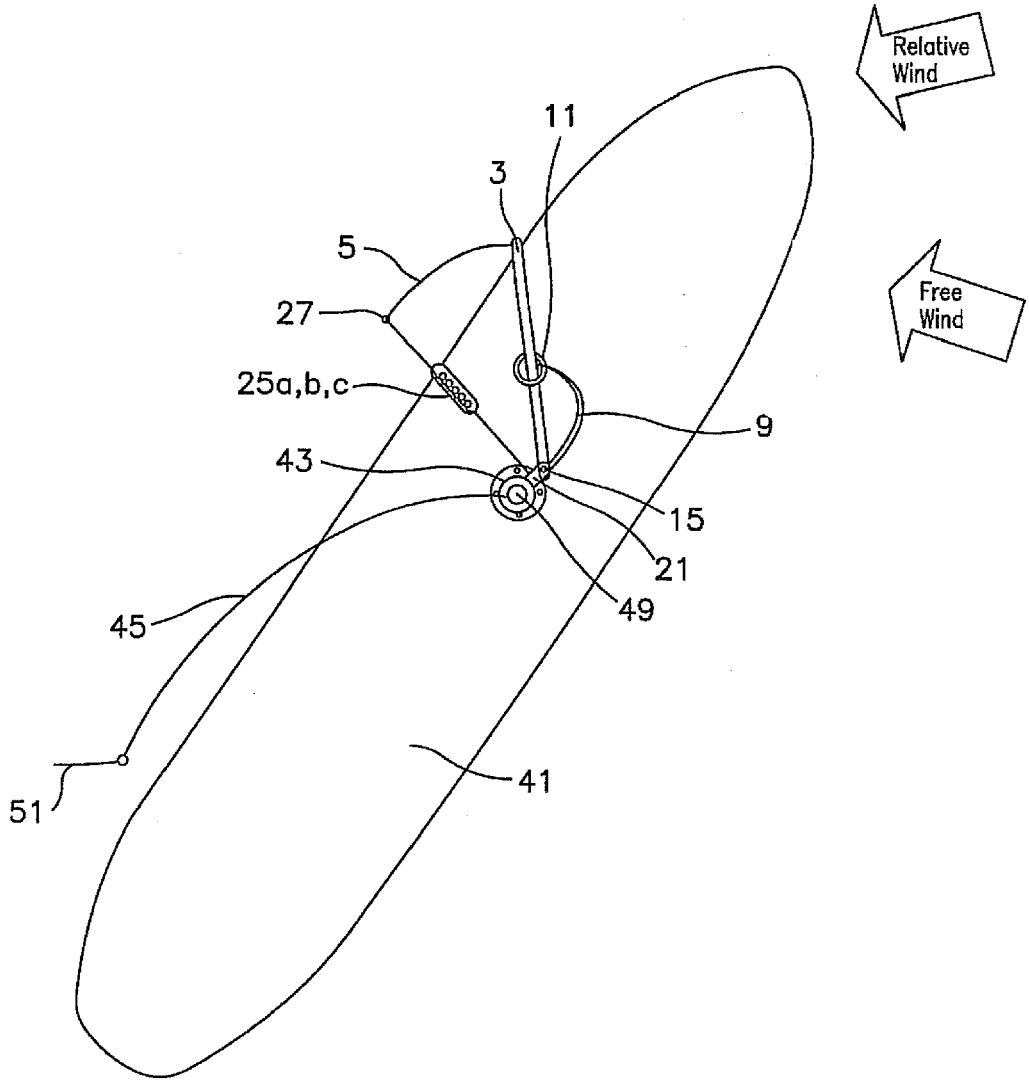
FIG. 2 is a top view showing the sailboard in motion.

With reference to FIGS. 1 and 2, the windsurfer includes a surfboard 41, and a fin 42, extending from the keel to stabilize the turn direction of the board. Also included is a sail 45 to propel the board, a frame 51 to hold the sail, a mast 49 to support the frame 51, and a ball and socket arrangement 43 to support the mast and to allow the board edges to tip laterally, and for the mast to turn such that the sail frame 51 can swing from side to side.

The rod frame 47 which is attached to sail frame 51 provides support for the rider and a means for turning the mast in the ball and socket arrangement, (i.e. to change the side of the sail to the wind).

The board can be steered by shifting weight such that the board edge will tip laterally to affect a bank turn. The turn is stabilized by the fin 42, and the leading edge of sail 45 is affixed to the mast 49.

For the purpose of this application, the width of gate valve sail 5 can be approximately ten to fifteen percent the width of sail 45. The mast 49 determines the length. The lift enhancement gate valve sail frame 3 supports the gate valve sail 5 and will swing on the hinge pin 15 which is affixed to frame hinge 21. The frame hinge 21 is affixed to the frame hinge base 19 which is affixed to the mast 49, via frame hinge 21 by a clamping arrangement with bolt fastener 17.

The frame hinge base 19 has points of attachment 23 for the elastic bands 25, a, b and c, which elastic bands vary in length to cause a progressive elastic tension which in conjunction with the variable spring tension of spring rod 9 will cause the progressive elastic tension effect between the air particles and the upwind surface of gate valve sail 5, coincidentally with the downwind cambered surface of sail 45, (the fluid gate).

The gate valve sail frame 3, the spring rod 9, and the spring rod ring 11 are placed such that when there is no wind, the resilient pressure of spring rods 9 will hold the edges 27 and 29 of the gate valve sail 5 in line with the mast 49, and the sail frame 51, (trailing edge). Spring rods 9, as shown, are constructed of composite material, but could be constructed of spring steel coils or rods.

The space between the trailing edge 27 of gate valve sail 5 and the gate hinge frame base 19, (i.e. mast 49) will form a fluid gate through which particles of air can flow. This arrangement places the side of the gate valve sail 5 at the same relative acute angle to the wind as the side of the sail 45. It is understood, when the downwind side of sail 45, is reversed to the wind, it will function in the same fashion (will become the upwind side).

When the gate valve sail 5 catches the wind it will cause the valve sail 5 to billow and will cause the valve hinge frame 3 to swing on hinge pin 15. Whereas, spring rod rings 11 will allow hinge frame 3 to slide on the inside of rod rings 11 which action will allow spring rods 9 to bend in such a way as to maintain the appropriate tension on the surface of gate valve sail 5. It will allow the chord of gate valve sail 5 and the chord of sail 45 to remain substantially parallel to one another, thereby reducing the dynamic drag factor.

In operation, the keel of the surf board 41, is placed at an acute angle to the wind. The longitudinal axis of the mast 49 is placed in the vertical plane. The side of the sail 45 is placed at an acute angle to the wind. The leading edge of sail 45 which is affixed to the mast 49, would be looking substantially upwind, such that the upwind surface will catch the wind and which will cause the surface on the downwind side of the sail to billow and form a cambered arc. The downwind surface will essentially function by the same aerodynamic principle as the downwind surface of an airfoil blade. Such an arrangement will cause a dynamic lift force to the sail 45 which will propel the board 41 forward in such a way that when the board 41 is placed in motion, an acute angle will form between the relative wind and the leading edge of sail 45, i.e. which acute angle will also form between the relative wind and the leading edge 29 of gate valve sail 5 and would typically be referred to as the relative angle of attack. The degree of such angle will depend on the relative speed of the wind and the board 41, whereas if the relative angle of attack were to become so steep, as the reach a point where the dynamic lift force would be lost, (stall) it would effect the top end forward speed of the board 41.

The wind velocity pressure present on the upwind surface of the sail 45 is equal (per square inch), to the wind velocity pressure present on the upwind surface of the gate valve sail 5. The wind velocity pressure at the upwind side of the fluid gate, (the space between trailing edge 27 of gate valve 5 and the leading edge of sail 45), will place a stress on the particles of air such that they tend to energize causing a force. The force will press on the upwind surface of the gate valve sail 5 causing a tension to the elastic bands 25*a, b* and *c*. The tension will cause the escaping air particles at the trailing edge 27 of gate valve sail to accelerate across the downwind cambered surface of the sail 45. This action will enhance the rare faction of the air particles on the downwind surface of sail 45.

It is well established that such action will rarefy the air, and will reduce the pressure on the downwind cambered surface of an airfoil or sail, i.e. enhancing the dynamic lift (torque) when the relative wind velocity increases. It will cause the surface pressure to increase on the upwind surface of gate valve sail 5, and the progressive tension of gate hinge frame spring rods 9 will allow the gate valve hinge frame 3 to swing on a hinge pin 15 in such a way that the upwind surface pressure on the gate valve sail 5 will cause the pressure to increase on the particles of air, as the particles flow through the fluid gate which action will increase the tension to elastic bands 25-*a* causing them to stretch to the point where they will take up the slack (the loop in the elastic band 25-*b*), which action will cause the elastic bands 25-*b* to engage thereby increasing pressure on the particles of air and causing those particles of air to continue acceleration through the fluid gate. The elastic bands 25-*c*, will engage in the same fashion, (Fluid gate is previously defined).

In FIG. 2 the valve sail frame 3, will swing on hinge pin 15, in such a way to cause the leading edge 29, ("Valve sail nose") to swing toward the trailing edge of sail 45, which action will cause the chord of sail 45, and the chord of valve sail 5, to remain substantially parallel to one another, i.e. the chord of valve sail 5 will substantially align itself with the boundary flow of air across the downwind cambered surface of sail 45, (FIG. 2.) and as the nose, or leading edge 29, of valve sail 5, continues to swing toward the trailing edge of sail 45, the relative wind at the leading edge of sail 45, will see less of the valve sail 5, such that the dynamic drag will be reduced (enhanced dynamic lift drag ratio) whereby the board 41, can attain a greater forward speed.

With the invention described above, it should be obvious that the dynamic lift enhancement gate valve has application for boats, yachts, wind turbines or practically anything propelled by a sail or airfoil blade.

While various examples and embodiments of the present invention have been shown and described, it will be appreciated by those skilled in the art that the spirit and scope of the present invention are not limited to the specific description and drawings herein, but extend to various modifications and changes.

What I now claim is:

1. A sailboard, said sailboard comprising:
- a surfboard having a mast;
- a main sail mounted on the mast;
- a ball and socket arrangement to support the mast and to allow the board to tip laterally and for the mast to turn;
- a rod frame attached to the mast to provide support for a rider;
- a gate valve assembly, wherein said gate valve assembly includes:
  - a gate valve sail mounted on a gate frame, said gate frame attaching the gate valve sail to the mast;
  - spring rods having spring rod rings, wherein the gate frame extends through the spring rod rings, and wherein the spring rods are attached to the gate frame to allow a resilient displacement of the gate frame with respect to the mast;
  - elastic bands attaching a trailing portion of the gate valve sail to the mast, said trailing portion and said mast defining a fluid gate;
- wherein when the sailboard is in wind, the wind displaces one or both of said gate valve sail and said gate frame to allow air passage through the fluid gate which reduces air drag and increases aerodynamic lift experienced by the main sail.

2. The sailboard of claim 1, wherein said gate frame is attached to the mast with hinge pins.

3. The sailboard of claim 1 wherein the gate valve sail is positioned on the surfboard forwardly of the main sail.

4. The sailboard of claim 1 wherein the gate valve sail has a leading portion hingedly attached to the gate frame, such that a change in wind velocity around the surfboard will cause the trailing portion of the gate valve sail to swing and move away from a leading portion of the main sail.

5. A gate valve sail assembly mounted on a sailboard, said assembly comprising:
- a mast supported on the sailboard, the mast being laterally moveable with respect to the sailboard and supporting a main sail board;
- a gate frame attached to the mast of the sailboard,
- an attachment structure attaching the gate frame to the mast;
- a gate valve sail having a leading edge and a trailing edge, said leading edge hingedly attached to the gate frame, said gate valve sail maintained in position by the gate frame;
- spring rods having spring rod rings, wherein the gate frame extends through the spring rod rings, and wherein the spring rods are attached to the gate frame to allow a resilient displacement of the gate frame with respect to the mast;
- elastic bands attaching a rear portion of the gate valve sail to the mast, a fluid gate defined by said trailing edge of said gate valve sail and said mast to allow air passage through the fluid gate, wherein when the sailboard is in wind, the wind displaces at least one of said gate valve sail and said gate frame to allow air passage through the gate, thereby reducing air drag and increasing aerodynamic lift experienced by the main sail.

6. The gate valve assembly of claim 5, wherein the attachment structure comprises hinge pins.

7. The sailboard of claim 5 wherein the main sail is positioned on the sailboard rearwardly of the gate valve sail.

8. The sailboard of claim 5 wherein a change in wind velocity around the sailboard will cause the trailing edge of the gate valve sail to swing and move away from a leading portion of the main sail.

* * * * *